United States Patent [19]

Smith

[11] 4,040,386

[45] Aug. 9, 1977

[54] RETRACTABLE EDGE SEALS FOR ELECTROSTATOGRAPHIC DEVELOPMENT SYSTEMS

[75] Inventor: Richard E. Smith, Webster, N.Y.

[73] Assignee: Xerox Corporation, Stamford, Conn.

[21] Appl. No.: 573,636

[22] Filed: May 1, 1975

[51] Int. Cl.[2] ..... G03G 15/08

[52] U.S. Cl. ..... 118/653

[58] Field of Search ..... 118/636, 637, 644, 653, 118/655

[56] References Cited

U.S. PATENT DOCUMENTS

| | | | |
|---|---|---|---|
| 3,424,131 | 1/1969 | Aser et al. | 118/637 |
| 3,592,642 | 7/1971 | Kaupp | 118/637 X |
| 3,635,196 | 1/1972 | Tsilibes | 118/637 |
| 3,809,012 | 5/1974 | Delvecchio | 118/636 X |
| 3,872,826 | 3/1975 | Hanson | 118/637 X |
| 3,872,828 | 3/1975 | Hartwig et al. | 118/637 |
| 3,924,944 | 12/1975 | Smith et al. | 118/637 X |
| 3,942,474 | 3/1976 | Smith et al. | 118/637 |

*Primary Examiner*—Mervin Stein

[57] ABSTRACT

An electrostatographic processor has a development system which is equipped with a split housing and with retractable edge seals which may be moved toward and away from the imaging surface of the processor independently of the housing for the development system.

9 Claims, 5 Drawing Figures

RETRACTABLE EDGE SEALS FOR ELECTROSTATOGRAPHIC DEVELOPMENT SYSTEMS

BACKGROUND OF THE INVENTION

This invention relates to development systems for electrostatographic processors and, more particularly, to retractable seals for development systems which are equipped with split housings.

In a conventional electrostatic printing process of the type described in Carlson's U.S. Pat No. 2,297,691 on "Electrophotography", a uniformly charged imaging surface is selectively discharged in an image configuration, thereby providing a latent electrostatic image which is then developed through the application of a finely divided coloring material, called "toner". That process has enjoyed outstanding commercial success, especially in plain paper, xerographic copiers and duplicators. However, it is not limited to xerography or to use in standalone copiers and duplicators. For example, there are electrostatographic processors which have appropriately controlled stylii for forming the latent image on the imaging surface. Furthermore, it has been found that electrostatographic printing may be advantageously utilized in a facsimile systems and computer printers, to name just a couple of its non-copier applications.

Modern electrostatographic processors typically carry out the development process on the fly — viz., as the imaging surface moves through a development zone. To accomplish that, there normally is a magnetic brush or a cascade development system for circulating a multi-component developer from a sump, through the development zone, and then back into the sump.

As will be appreciated, a multi-component developer is basically a mixture of toner particles and larger so-called "carrier" particles. In practice, the materials for the toner and carrier (or, sometimes, carrier coating) components of the mixture are selected so that they are removed from one another in the triboelectric series, whereby electrical charges of opposite polarities tend to be imparted to the toner and carrier particles when the developer components are blended together. Furthermore, in selecting those materials, consideration is given to their relative triboelectric ranking to the end that the polarity of the nominal charge for the toner particles opposes the polarity of the latent images which are to be developed. Consequently, in operation, there are competing electrostatic forces acting on the toner particles. That is, one set of forces tends to attract them to the carrier particles, while another set of forces tends to electrostatically strip them from that portion of the developer which is brought into the immediate proximity of or actual contact with the image bearing imaging surface.

Experience has shown that the development process is sensitive to any variations in the dimensions of the development zone. For that reason, it has recently been suggested that the development system for an electrostatographic processor should have a split housing so that the development system can be internally accessed for maintenance purposes or the like, without upsetting the development zone (i.e., the interface between the development system and the imaging surface). Copending and commonly assigned United States patent applications on various aspects of that basic concept have been filed by R. E. Smith and H. L. Bresnick under Ser. No. 525,532 now U.S. Pat No. 3,924,944, issued Dec. 9, 1975 ; R. E. Smith under Ser. No. 525,528 now U.S. Pat. No. 3,981,272, issued Sept. 21, 1976 ; and R. E. Smith and J. E. Forward under Ser. No. 525,530, now U.S. Pat. No. 3,998,537, issued Dec. 21, 1976. Thus, those applications are hereby incorporated by reference.

When an electrostatographic processor is equipped with, say, a cascadeor magnetic brush development system, there necessarily are so-called "edge seals" between the imaging surface and the housing for the development system to prevent developer from escaping as it circulates through the development zone. As a general rule, the entire development system is mounted for movement toward and away from the imaging surface. Thus, the edge seals are customarily resilient members which extend forwardly from the housing for the development system to be brought into pressure contact with and retracted from the imaging surface in response to the movement of the development system.

SUMMARY OF THE INVENTION

In contrast, an object of the present invention is to provide a development system with seals which may be brought into pressure contact with and retracted from the imaging surface of an electrostatographic processor without moving the housing for the development system. More particularly, an object is to provide edge seals which are suitable for use with development systems which have split housings.

Briefly, to carry out these and other objects of the invention, the edge seals comprise resilient members which are secured to support plates which, in turn, are mounted on the development system housing for movement toward and away from the imaging surface of the processor, independently of the housing and under the control of an operator.

BRIEF DESCRIPTION OF THE DRAWINGS

Still further objects and advantages of this invention will become apparent when the following detailed description is read in conjunction with the attached drawings, in which.

DETAILED DESCRIPTION OF THE ILLUSTRATED EMBODIMENT

While the invention is described in some detail hereinafter with reference to a specific embodiment, it should be understood at the very outset that there is no intent to limit it to that embodiment. On the contrary, the aim is to cover all modifications, alternatives and equivalents falling within the spirit and scope of the invention as defined by the appended claims.

Figure 1:
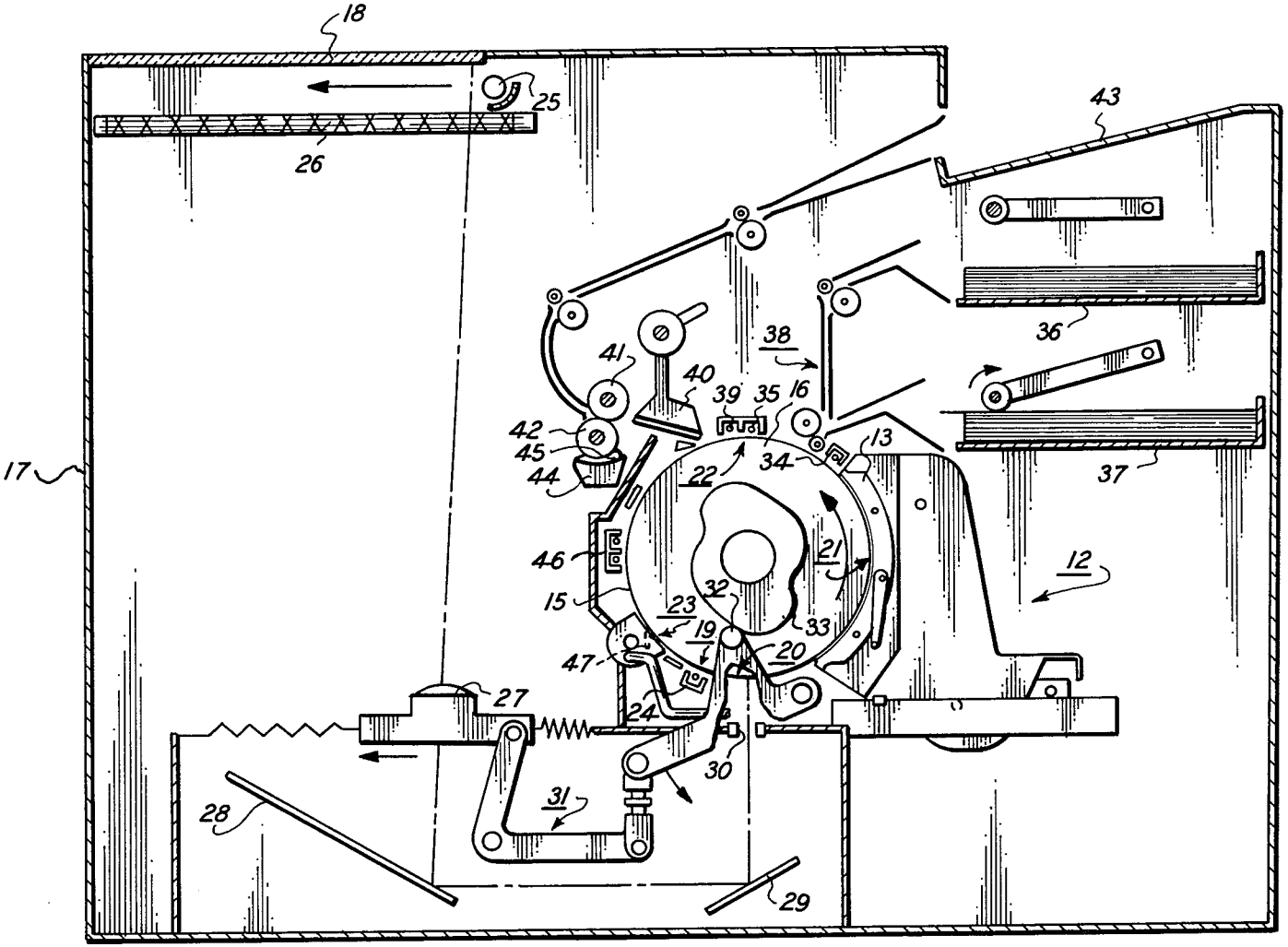
FIG. 1 is a simplified schematic diagram of an electrostatographic processor having a development system with edge seals which are constructed in accordance with the present invention.
Figure 2:
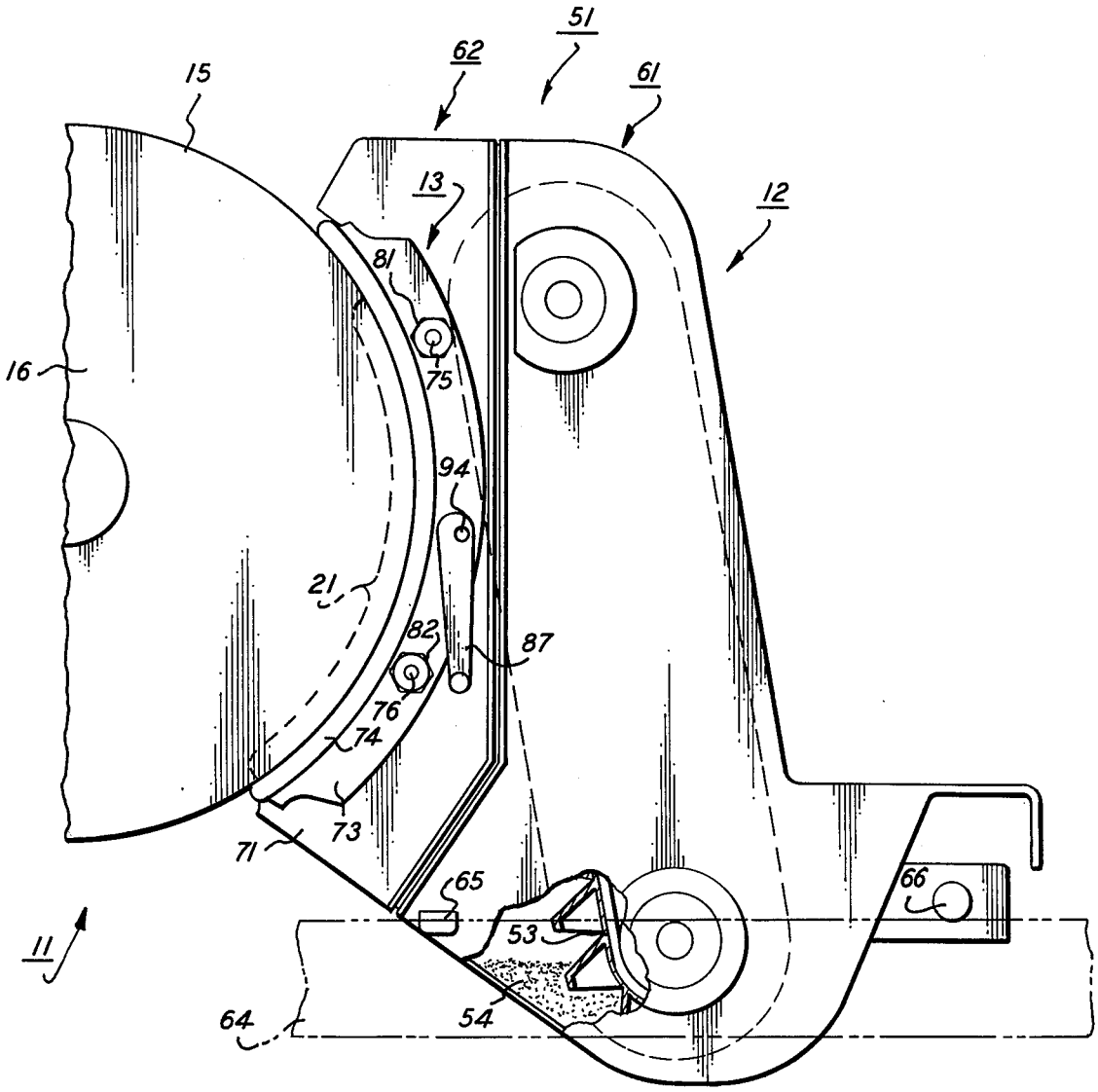
FIG. 2 is an enlarged, fragmentary view showing the development system and one of the edge seals in additional detail.
Figure 4:
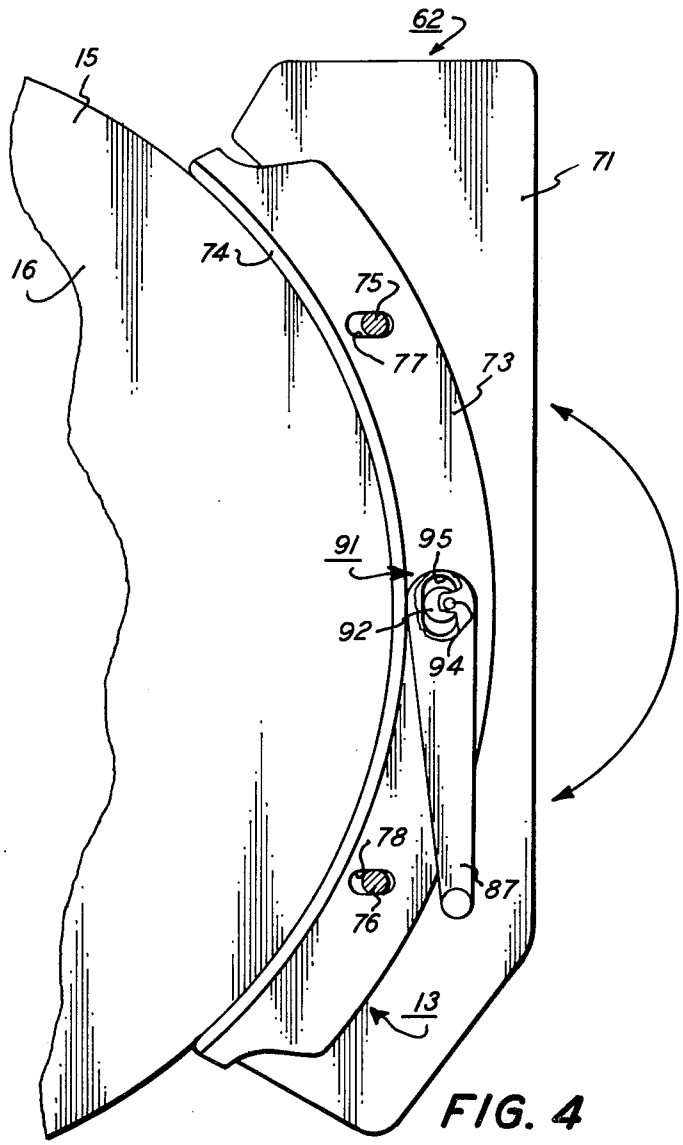
FIG. 4 is similar to the view of FIG. 3, except that the edge seal is engaged with the imaging surface of the processor.
Figure 3:
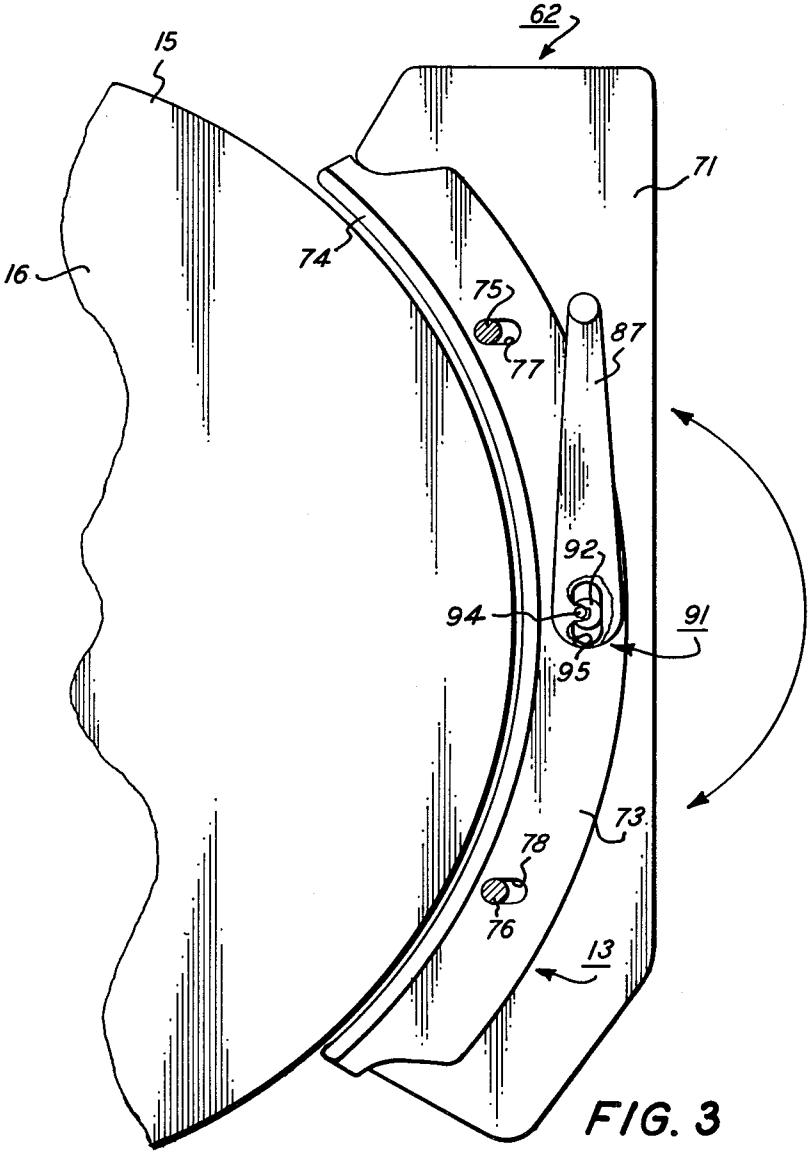
FIG. 3 is another fragmentary view which has been further enlarged to illustrate the edge seals as they appear when they are retracted from the imaging surface of the processor.

Turning now to the drawings, and at this point especially to FIG. 1, it will be seen that there is an electrostatographic processor 11 having a development system 12 with edge seals 13 and 14 (FIG. 5) constructed in accordance with this invention. In this instance, the processor 11 is a xerographic copier having a photosensitive imaging surface 15 coated on the surface of a rotatable drum 16. Nevertheless, it will be appreciated that there are other suitable machine configurations, including one wherein a flexible photoconductor is supported by a belt-like substrate.

There is no reason to dwell on the processor 11. It is simply an exemplary environment for this invention, and it closely resembles a commercially available "4000" copier of Xerox Corporation as modified to include the development system 12. Anyone interested in the specific details of that copier may, of course, inspect one of the commercially available units or refer to the published literature pertaining thereto, such as U.S. Pat. No. 3,742,019, which issued Apr. 3, 1973 in the name of Alan L. Shanly. Hence, a brief functional description will suffice.

Considering the processor 11 on that level, it will be observed that the drum 16 and its related components are enclosed within a base frame 17 which has a transparent platen 18 for supporting a document or the like (i.e., the subject copy) image side down in position to be copied. The drum 16 is rotatably driven in the direction of the arrow so that the imaging surface 15 is sequentially advanced during each copying cycle through a charging station 19, an exposure station 20, a development zone 21, a transfer station 22, and a cleaning station 23.

At the outset of each copying cycle, the imaging surface 15 is uniformly charged by a corona generaor 24 as it advances through the charging station 19 and then selectively discharged in respose to light reflected from the subject copy as it advances through the exposure station 20. There is, therefore, a latent electrostatic image of the subject copy on the imaging surface 15 when it reaches the development zone 21.

To carry out the exposure step, this particular copier comprises a scanning lamp 25 which is driven from one side to the other of the platen 18 by a double helix auger drive 26 twice each copying cycle to illuminate successive lines or strips of the subject copy from below. The light reflected from the subject copy is intensity modulated in accordance with the image of interest and is focused on the imaging surface 15 by a movable lens 27, a pair of stationary mirrors 28 and 29, and an exposure slit 30. To maintain the focus, the movable lens 27 is laterally driven in timed synchronism with the scanning lamp 25. That is accomplished by means of linkage 31 which has a follower 32 riding on a profiled camming surface 33, which, in turn, is mounted for rotation with the drum 16.

As described in more detail hereinbelow, the development system 12 circulates a multi-component developer through the development zone 21 to tone or develop the latent images carried by the imaging surface 15 on the fly - viz., as the imaging surface 15 through the development zone 21. Thereafter, the charge carried by the toner deposited on the imaging surface 15 is partially neutralized by a pre-transfer corona generator 34, thereby conditioning the toned or developed image for transfer to a copy sheet (not shown) under the influence of a transfer corona generator 35 at the transfer station 22. The copy sheet is selectively fed from one of two supply trays 36 and 37 and is brought into contact with the imaging surface 15 by a sheet feeding and registration mechanism which is schematically shown at 38.

Continued rotation of the drum 16 advances the imaging surface 15 and the copy sheet beneath a detack corona generator 39 and then to a vacuum-type stripper 40. The detack corona generator 39 at least partially neutralizes the charge provded by he transfer corona generator 35, thereby assisting the stripper 40 in removing the copy sheet from the imaging surface 15.

The copy sheet is transported from the stripper 40 and into the nip between a pair of heated fuser rolls 41 and 42 which supply heat and pressure for fixing the toned image to the copy sheet. Consequently, the ultimate copy fed into the output tray 43 has a substantial degree of permanence. To minimize the tendency for toner to offset during the fusing process, there preferably is a reservoir 44 with a wick 45 for applying a release agent, such as silicone oil, to the lower fuser roll 42, which is the one that engages the image bearing side of the subject copy.

While fusing is taking place, the imaging surface 15 advances into the cleaning station 23 where there is a pre-cleaning corona generator 46 which is followed by a cleaning blade 47. The corona generator 46 at least partially neutralizes the charge tending to hold he residual toner in place, and the cleaning blade 47 then removes that toner from the imaging surface 15 in preparation for another copying cycle.

Referring to FIGS. 2–5, it will be apparent that the development system 12 is similar to prior so-called "cascade" systems, with the principal exception being that this system is housed in a "split" housing 51 to highlight the advantages of the edge seals 13 and 14 provided in accordance with this invention.

Briefly, in keeping with accepted practices, the development system 12 comprises a hopper (not shown) for guiding developer into the development zone 21, a bucket-type conveyor 53 for transporting developer from a sump 54 in the lower reaches of the housing 51 to a position above the hopper, and a chute (also not shown) for recovering developer from the development zone 21 and returning it to the sump 54. The hopper and the chute are positioned immediately above and below, respectively, the development zone 21. Accordingly, in operation, developer circulates in a more or less conventional path which runs upwardly from the sump 54 along the conveyor 53 and then downwardly through the hopper, then the development zone 21, and finally back to the sump 54 via the chute.

Development occurs because the developer falling through the development zone 21 cascades across the photoconductor 15. As is known, a development electrode (not shown) is often included in a system of this type on the opposite side of the development zone 21 from the photoconductor 15 (i.e., so that there is a predetermined space or gap between the development electrode and the imaging surface). Typically, the development electrode is used to suppress background development. To accomplish that, in operation, it is electrically biased (by means not shown) relative to the drum 16 to provide an eletrostatic field which tends to neutralize the electrostatic forces which might otherwise tend to attract toner to the non-image or backgound areas of the photoconductor 15.

As will be appreciated, a development zone of substantially constant dimensions is a basic requirement for obtaining consistent performance from this or most any other development system. For that reason, the housing 51 is "split" so that the development system 12 may be internally accessed for maintenance purposes and the like, without disturbing its interface with the photoconductor 15 (i.e., without altering, or even temporally upsetting, any of the dimensions of the development zone 21).

More particularly, the housing 51 comprises an outboard movable section 61 which is releasably secured (by means not shown) to an inboard stationary section 62 by a catch mechanism (not shown). The stationary section 62 is more or less permanently held in position immediately adjacent the photoconductor 15 and includes at least those components of the development system 12 which participate in defining the development zone 21. Here, for example, the aforementioned hopper, chute and development electrode are mounted within the stationary section 62 which, in turn, is rigidly attached (by means not shown) to the base frame 17 of the processor 11 (FIG. 1). The movable section 61, on the other hand, houses the conveyor 53 and the sump 54 and is supported on, say, a pair of generally horizontal rails 64 (only one can be seen) for sliding movement toward and away from the stationary section 62. As shown there are forward and rearward bearings 65 and 66, respectively, extending outwardly from each side of the movable section 61 to bridge that section between the rails 64. The rails 64 are, of course, anchored (by means not shown) to the processor base frame 17. For an even more detailed description of the exemplary housing 51, reference may be had to the aforementioned United States patent application of Richard E. Smith and Herbert L. Bresnick, Ser. No. 525,532.

Figure 5:
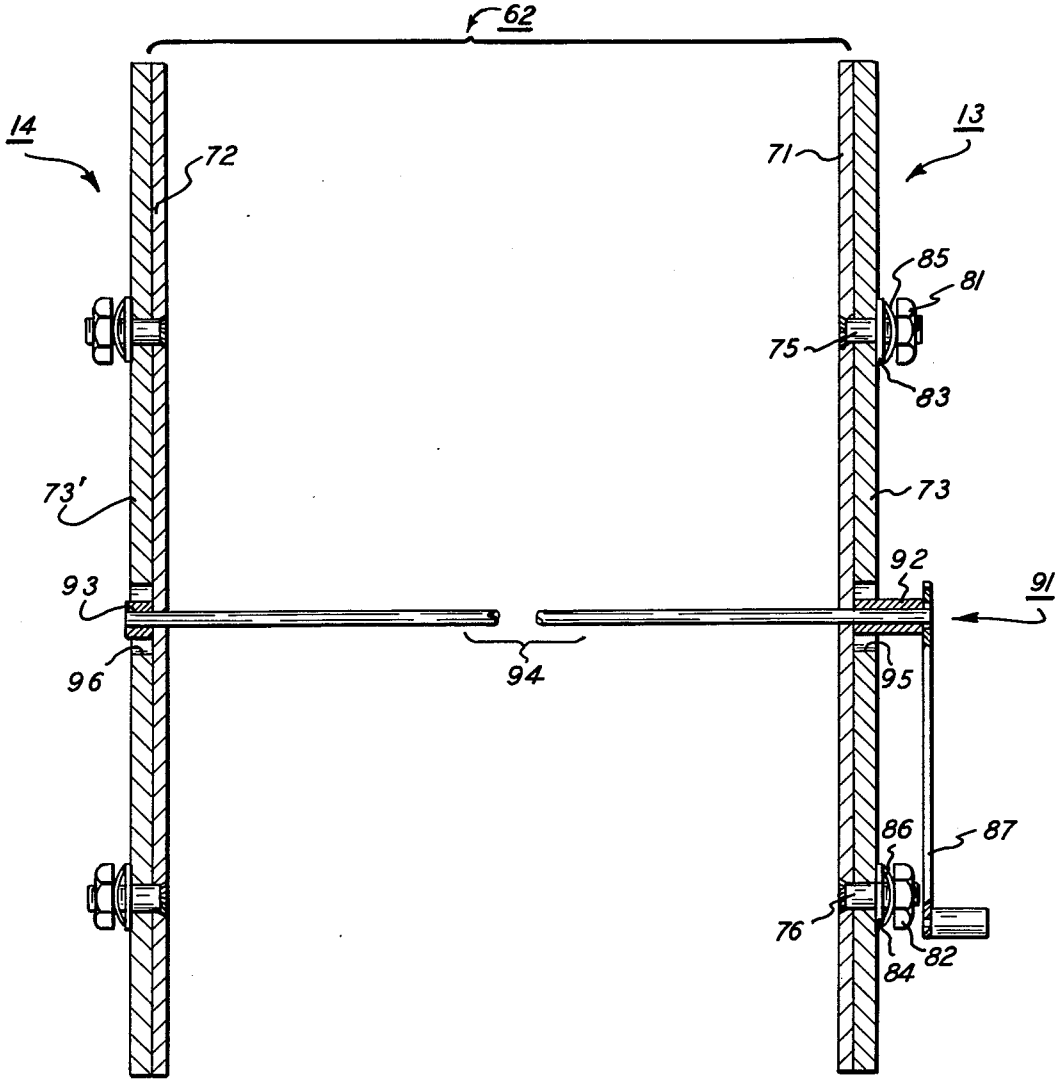
FIG. 5 is a fragmentary, simplified sectional view of the development system which illustrates the drive mechanism for the edge seals.

In accordance with this invention, provision is made for moving the edge seals 13 and 14 of the development system 12 toward and away from the photoconductor 15 independently of the housing 51. As will be appreciated, that is an especially important feature in this instance because the housing 51 is split. Specifically, as best shown in FIG. 5, the edge seals 13 and 14 are mounted on opposite sides 71 and 72, respectively, of the stationary section 62 of the housing 51 in alignment with opposite lateral edges of the development zone 21. As will be recalled, the stationary section 62 is more or less permanently held in place. Thus, the important advantage of this invention is that the edge seals 13 and 14 may be moved (1) forwardly into pressure contact with the photoconductor 15 to seal the development zone 21 for operation and (2) rearwardly away from the photoconductor 15, thereby providing the access necessary to perform various maintenance procedures, such as removing the drum 16 from the processor 11.

Taking the edge seal 13 as being generally representative, it will be seen that it comprises a support plate 73 which has an elongated resilient member 74 secured to its forward edge. In keeping with this invention, the support plate 73 is mounted on the sidewall 71 of the stationary section 62 of the housing 51 for movement toward and away from the photoconductor 15. To that end, in the illustrated embodiment, there are a pair of spaced apart pins 75 and 76 which are anchored on the sidewall 71 and which extend outwardly therefrom through enlarged slots 77 and 78, respectively, in the support plate 73. The support plate 73 is held in place by nuts 81 and 82 which are threaded on the outer ends of the pins 75 and 76 and tightened down against flat washers 83 and 84 and spring washers 85 and 86, respectively. The spring washers 85 and 86 bias the suport plate 73 against the housing sidewall 71. Hence, a seal is readily provided therebetween simply by coating the inner face of the support plate 73 with a layer of resilient material (not shown). The resilient member or strip 74, on the other hand, has an arcuate configuration to conform to the cylindrical contour of the photoconductor 15.

To carry out one of the more detailed aspects of this invention, there is a convenient and reliable drive mechanism 91 for the operator to use when there is reason to move the edge seals 13 and 14 toward or away from the photoconductor 15. That is, as shown, there are a pair of matched collar-like eccentrics 92 and 93 which are mounted for rotation with a shaft 94. The shaft 94 is journalled for rotation in the sidewalls 71 and 72 of the stationary section 62 of the housing 51, and the eccentrics 92 and 93 are seated within slots 95 and 96 in the support plates 73 and 73' for the edge seals 13 and 14, respectively. Furthermore, a hand crank 87 is connected to the shaft 94 so that the operator may rotate the eccentrics 92 and 93, thereby camming the edge seals 13 and 14 toward or away from the photoconductor 15. Inasmuch as the eccentrics 92 and 93 are matched (i.e., substantially identical in dimensions and angular orientation), the edge seals 13 and 14 move in unison.

CONCLUSION

In view of the foregiong, it will be appreciated that the present invention provides moveable or retractable edge seals which may be utilized to special advantage in development systems having split housings.

What is claimed is:

1. In a development system for developing latent electrostatic images carried by an imaging surface of an electrostatographic processor as said imaging surface moves through a development zone; said development system including a housing having a sump for storing a supply of developer, and means within said housing for circulating developer along a path running from said sump, through said development zone, and then back into said sump; the improvement comprising at least one retractable sealing means mounted on said housing for movement toward and away from said imaging surface independently of said housing; said sealing means being aligned with one edge of said development zone to selectively seal and unseal said development zone along said edge while said housing is maintained in a predetermined position, said sealing means comprising a support plate mounted on said housing for movement toward and away from said imaging surface, a resilient member secured to said support plate in facing relationship with said imaging surface and in alignment with said one edge of said development zone, and a manually controlled drive mechanism coupled to said support plate to enable an operator to selectively engage and disengage said resilient member with and from, respectively, said imaging surface, said drive mechanism including a shaft journalled for rotation in said housing, an eccentric mounted for rotation with said shaft, and a crank coupled to said shaft for rotating said eccentric; said eccentric extending through a slot in said support plate, whereby said support plate is cammed toward and away from said imaging surface in response to the rotation of said eccentric.

2. The improvement of claim 1 wherein said support plate is mounted on one side of said housing for movement toward and away from said imaging surface, said resilient member is aligned with a lateral edge of said development zone, said imaging surface has a predetermined contour longitudinally of said development zone, and said resilient member is elongated and longitudinally configured to conform to said contour.

3. The improvement of claim 2 wherein said housing has a stationary section adjacent said imaging surface to define said development zone, and a movable section mounted for movement toward and away from said stationary section to provide internal access to said development system; and wherein said support plate is mounted on said shaft and is journalled in the stationary section of said housing.

4. The improvement of claim 3 wherein said imaging surface has a cylinderical contour, and said resilient member is aruate to conform to said contour.

5. A development system for developing latent electrostatic images carried by an imaging surface of an electrostatographic processor as said imaging surface moves through a development zone; said development system comprising:

a housing having a stationary section adjacent said imaging surface to define said development zone, and a movable section mounted for movement toward and away from said stationary section to provide internal access to said development system;

a sump within the movable section of said housing for storing a supply of developer;

means within the stationary and movable sections of said housing for circulating developer in a path running from said sump, through said development zone, and then back into said sump; and a pair of retractable sealing means mounted on opposite sides of the stationary section of said housing for movement toward and away from said imaging surface, said sealing means being aligned with opposite lateral edges of said development zone to selectively seal and unseal said development zone along said edges while the stationary section of said housing is maintained in a predetermined position, said sealing means including respective resilient members extending lengthwise of said development zone facing relationship with said imaging surface, said imaging surface having a predetermined contour lengthwise of said development zone, each of said resilient members being longitudinally configured to conform to said countour, said sealing means including respective support plates mounted on opposite sides of the stationary section of said housing for movement toward and away from said imaging surface; separate resilient members secured to respective ones of said support plates in facing relationship with said imaging surface and in alignment with opposite ones of said edges of said development zone, and a manually controlled drive mechanism coupled to said support plates for engaging and disengaging said resilient members with and from, respectively, said imaging surface under the control of an operator.

6. The development system of claim 5 wherein said imaging surface has a cylindrical contour, and said resilient members are arcuate to conform to said contour.

7. The development system of claim 6 wherein said imaging surface has a predetermined contour lengthwise of said development zone, and said resilient members are elongated and longitudinally configured to conform to said contour.

8. The development system of claim 6 wherein said drive mechanism includes a shaft journalled for rotation in the stationary section of said housing, a pair of eccentrics mounted for rotation with said shaft, and a crank coupled to said shaft for rotating said eccentrics under the control of said operator; said eccentrics extending through slots in respective ones of said support plates, whereby said support plates are cammed toward and away from said imaging surface in unison in response to the rotation of said eccentrics.

9. The development system of claim 8 wherein said imaging surface has a cylinderical contour, and said resilient members are elongated and arcuate to conform to said contour.

* * * * *